US012577011B2

(12) United States Patent
Chen et al.

(10) Patent No.: US 12,577,011 B2
(45) Date of Patent: Mar. 17, 2026

(54) SYSTEM AND METHOD FOR LIDDING A CONTAINER

(71) Applicant: ABB SCHWEIZ AG, Baden (CH)

(72) Inventors: Junping Chen, Shanghai (CN); Weiyang Shi, Shanghai (CN); Wenyong Zhou, Shanghai (CN); Dongjie Guo, Shanghai (CN)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 18/927,413

(22) Filed: Oct. 25, 2024

(65) Prior Publication Data

US 2025/0042591 A1 Feb. 6, 2025

Related U.S. Application Data

(63) Continuation of application No. PCT/CN2022/092821, filed on May 13, 2022.

(51) Int. Cl.
*B65B 57/02* (2006.01)
*B65B 7/28* (2006.01)

(52) U.S. Cl.
CPC ..... *B65B 57/02* (2013.01); *B65B 7/28* (2013.01); *B65B 7/2807* (2013.01); *B65B 7/2842* (2013.01)

(58) Field of Classification Search
CPC ..... B65B 7/28; B65B 7/2807; B65B 7/2842; B65B 7/2857; B65B 57/02
USPC ..... 53/485, 75, 76, 306, 310, 311, 312, 313, 53/314, 342, 367
See application file for complete search history.

(56) References Cited

U.S. PATENT DOCUMENTS

| | | | | |
|---|---|---|---|---|
| 2,850,858 | A * | 9/1958 | Daly et al. | B65B 7/28 53/367 |
| 2,996,859 | A * | 8/1961 | Winkler et al. | B65B 25/141 53/367 |
| 3,810,345 | A * | 5/1974 | Lemmond et al. | B65B 7/2807 53/367 |
| 4,285,186 | A | 8/1981 | Desom | |
| 4,559,760 | A | 12/1985 | Daniels et al. | |
| 5,437,361 | A | 8/1995 | Ohmori et al. | |
| 5,438,814 | A * | 8/1995 | Lovett et al. | B65B 7/2807 53/367 |
| 6,418,701 | B1 * | 7/2002 | Navarro | B65B 7/2807 53/367 |
| 2016/0176651 | A1 | 6/2016 | Landler et al. | |
| 2021/0139258 | A1 * | 5/2021 | Kirihara et al. | B65B 7/2842 |

FOREIGN PATENT DOCUMENTS

| | | | |
|---|---|---|---|
| CN | 103318820 | A | 9/2013 |
| CN | 105452133 | A | 3/2016 |
| CN | 207748827 | U | 8/2018 |

(Continued)

*Primary Examiner* — Stephen F. Gerrity
(74) *Attorney, Agent, or Firm* — Greenberg Traurig, LLP

(57) ABSTRACT

Embodiments of present disclosure relate to a system for lidding a container and a method for lidding a container. The system for lidding a container includes a conveying device configured to convey a container, the container having a non-circular opening. The system includes a lid retaining assembly configured to retain a lid in a fixed orientation, and a container adjustment device configured to adjust a posture of the container to be lidded on the conveying device, so that the opening of the container is aligned with the lid.

15 Claims, 12 Drawing Sheets

(56) References Cited

FOREIGN PATENT DOCUMENTS

| | | | | | |
|---|---|---|---|---|---|
| CN | 109179286 | A | | 1/2019 | |
| CN | 208856878 | U | | 5/2019 | |
| CN | 208963890 | U | | 6/2019 | |
| CN | 211419522 | U | | 9/2020 | |
| CN | 112009983 | A | | 12/2020 | |
| CN | 112623305 | A | | 4/2021 | |
| CN | 113646234 | A | | 11/2021 | |
| CN | 215711741 | U | | 2/2022 | |
| FR | 2571348 | A1 | * | 4/1986 | ..... B67B 3/064 |
| FR | 2678900 | A1 | * | 1/1993 | ..... B65B 7/2842 |
| JP | H08143098 | A | * | 6/1996 | |
| JP | 2014227295 | A | * | 12/2014 | |
| WO | 2020161759 | A1 | | 8/2020 | |

* cited by examiner

SYSTEM AND METHOD FOR LIDDING A CONTAINER

CROSS-REFERENCE TO RELATED APPLICATIONS

This application claims priority to and is a continuation application of international patent application number PCT/CN2022/092821, filed on May 13, 2022, which is herein incorporated by reference in its entirety.

FIELD

Embodiments of the present disclosure generally relate to the field of lidding apparatus, and more particularly, to a system for lidding a container and a method for lidding a container.

BACKGROUND

There is an increasing demand for food portioning in the central kitchen. For some food containers, it is necessary to add a lid after portioning. So far, it is done manually, which has a disadvantageous impact on food safety, and the work is repetitive and monotonous. Typically, for food containers, such as lunch boxes, the opening is not circular. It is difficult to directly apply conventional devices for capping beverage bottles. There thus is a need for a new approach for reducing the workload of lidding a lid on the container after portioning, and improving the food safety.

SUMMARY

In view of the foregoing problems, various example embodiments of the present disclosure provide a system for lidding a container and a method for lidding a container for reducing the workload of lidding a lid on the container after portioning, and improving the food safety in a manner of high efficiency and user friendly.

In a first aspect of the present disclosure, example embodiments of the present disclosure provide a system for lidding a container. The system for lidding a container comprises: a conveying device configured to convey a container, the container having a non-circular opening; a lid retaining assembly configured to retain a lid in a fixed orientation; and a container adjustment device configured to adjust a posture of the container to be lidded on the conveying device, so that the opening of the container is aligned with the lid.

With such an arrangement, the workload of lidding a lid on the container after portioning is reduced, and the food safety is improved.

In some embodiments, the container adjustment device comprises: a first adjustment assembly, and a second adjustment assembly; wherein the first adjustment assembly and the second adjustment assembly are configured to move between a first predetermined position in which the first adjustment assembly and the second adjustment assembly are far away from each other such that the container can enter a gap formed by the first adjustment assembly and the second adjustment assembly and a second predetermined position in which the first adjustment assembly and the second adjustment assembly approach such that the gap can be narrowed so as to adjust the posture of the container by the approach movement of the first adjustment assembly and the second adjustment assembly, wherein an orientation of the gap is consistent with the orientation of the opening of the container when the first adjustment assembly and the second adjustment assembly are at the second predetermined position.

With such an arrangement, the first adjustment assembly and the second adjustment assembly can move with respect to each other, thereby contacting the opposite sides of the container to adjust the posture of the container. In this way, the posture of the container can be adjusted conveniently.

In some embodiments, the container adjustment device further comprises a gripper configured to drive the first adjustment assembly and a second adjustment assembly.

With such an arrangement, sine the gripper can act quickly, the first adjustment assembly and the second adjustment assembly can be driven correspondingly.

In some embodiments, the gripper comprises a body defining a chamber and two pistons received in the chamber, the two pistons are configured to move in response to pressure increase and decrease in the chamber, and the first adjustment assembly and the second adjustment assembly are coupled to the two pistons respectively via a link-mechanism.

With such an arrangement, the first adjustment assembly and the second adjustment assembly can be driven quickly, whereby the container adjustment can be achieved in an efficient way.

In some embodiments, the first adjustment assembly comprises a first pole and a second pole extending in parallel with the first pole, the first pole and the second pole being configured to contact a first side of the container respectively when the first adjustment assembly and the second adjustment assembly are at the second predetermined position; and the second adjustment assembly comprises a third pole and a fourth pole extending in parallel with third pole, the third pole and the fourth pole being configured to contact a second side of the container opposite to the first side when the first adjustment assembly and the second adjustment assembly are at the second predetermined position.

With such an arrangement, first pole and the second pole and the third pole and a fourth pole are adapted to contact different positions of the container. In this way, containers of different shapes can be adjusted.

In some embodiments, the first adjustment assembly comprises a first elongate member shaped to move the container into a predetermined orientation; the second adjustment assembly comprises a second elongate member shaped to move the container into a predetermined orientation; and wherein the first elongate member and the second elongate member are configured to contact the opposite sides of the container respectively when the first adjustment assembly and the second adjustment assembly are at the second predetermined position.

With such an arrangement, the posture of the container can be adjusted in an efficient and reliable way.

In some embodiments, the lid retaining assembly comprises at least one flexible suckers configured to suck a top surface of the lid, wherein the at least one flexible suckers are configured to retain the lid in a fixed and predetermined orientation.

With such an arrangement, the lid can be picked up quickly and reliably. Moreover, the lid is retained in a fixed and predetermined orientation, such that the posture of the container can be adjusted to be consistent with the orientation of the lid.

In some embodiments, the lid retaining assembly further comprises: a sucker auxiliary part having a rigid surface configured to abut against the top surface of the lid when the sucker sucks the lid.

With such an arrangement, it enables the sucker holds the lid firmly.

In some embodiments, the system further comprising: a lid distribution device configured to distribute the lid to a predetermined position with the lid being in a predetermined orientation.

With such an arrangement, it enables the posture of the container to be adjusted quickly.

In some embodiments, the lid distribution device comprises a conveying belt comprising two opposite walls for supporting the lid; an pick up station comprising an groove at which the lid are to be picked up by lid retaining assembly; and a pusher configured to push the lid on the conveying belt to the groove.

With such an arrangement, the lid can be conveyed quickly to a predetermined position, the efficiency can be improved greatly.

In some embodiments, the pusher comprises a movable plate comprising a first side and a second side, the first side is configured to push the lid, and the second side is configured to block a subsequent lid.

With such an arrangement, the lid can be located accurately in a predetermined position, which is helpful for subsequent container adjustment.

In some embodiments, the system further comprises a lidding device configured to lid the lid over the opening of the container after the posture of container (70) has been adjusted.

With such an arrangement, the position and speed of the container can be determined accurately, thereby the lid can be lidded on the container quickly and accurately.

In some embodiments, the lidding device further comprises a position and speed determination device comprising: a sensor configured to generate an indication signal when the container enters a working area; and an encoder ratably arranged on a drive roller of the conveying device configured to periodically transmit pulse signals according to a travel distance of the conveying device; and a position and speed determination unit configured to determine a position and speed of the container based on the number of pulse signals and the indication signal.

With such an arrangement, the position and speed of the container can be determined in a cost efficient way.

In a second aspect of the present disclosure, example embodiments of the present disclosure provide a method for lidding a container. The method comprises: conveying a container, the container having a non-circular opening; retaining a lid in a fixed direction; adjusting the posture of the container to be lidded, so that the opening of the container is aligned with the lid; and lidding the lid over the aligned opening of the container.

With such an arrangement, the workload of lidding a lid on the container after portioning is reduced, and the food safety is improved.

In some embodiments, adjusting the posture of the container to be lidded comprises: moving a first adjustment assembly and a second adjustment assembly between a first predetermined position in which the first adjustment assembly and the second adjustment assembly are far away from each other such that the container can enter a gap formed by the first adjustment assembly and the second adjustment assembly and a second predetermined position in which the first adjustment assembly and the second adjustment assembly approach such that the gap can be narrowed so as to adjust the posture of the container by the approach movement of the first adjustment assembly and the second adjustment assembly.

With such an arrangement, the posture of the container can be adjusted conveniently and accurately.

It is to be understood that the Summary section is not intended to identify key or essential features of embodiments of the present disclosure, nor is it intended to be used to limit the scope of the present disclosure. Other features of the present disclosure will become easily comprehensible through the following description.

DESCRIPTION OF DRAWINGS

Through the following detailed descriptions with reference to the accompanying drawings, the above and other objectives, features and advantages of the example embodiments disclosed herein will become more comprehensible. In the drawings, several example embodiments disclosed herein will be illustrated in an example and in a non-limiting manner, wherein.

Throughout the drawings, the same or similar reference symbols are used to indicate the same or similar elements.

DETAILED DESCRIPTION OF EMBODIMENTS

Figure 1:
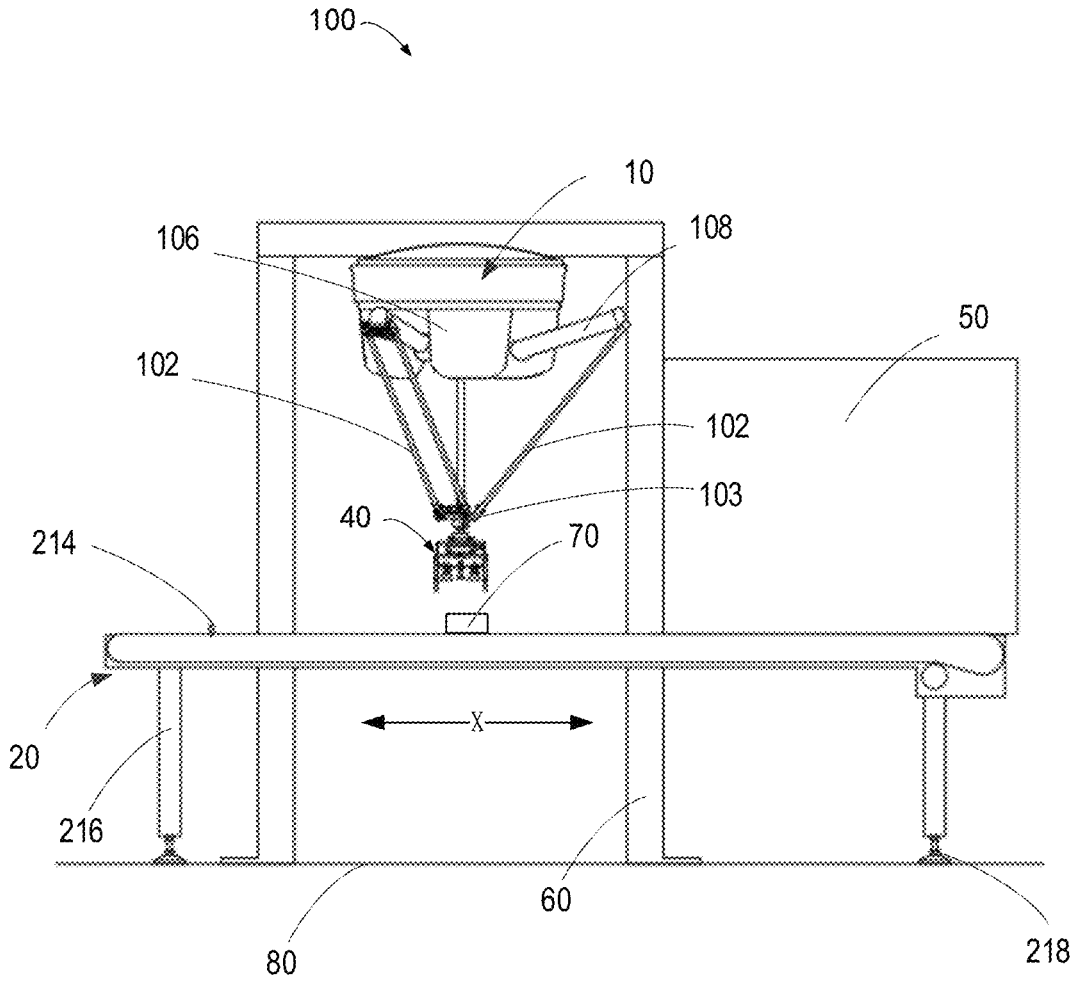
FIG. 1 is a schematic front view illustrating an system for lidding a container in accordance with an embodiment of the present disclosure.

Principles of the present disclosure will now be described with reference to several example embodiments shown in the drawings. Though example embodiments of the present disclosure are illustrated in the drawings, it is to be understood that the embodiments are described only to facilitate those skilled in the art in better understanding and thereby achieving the present disclosure, rather than to limit the scope of the disclosure in any manner.

The term "comprises" or "includes" and its variants are to be read as open terms that mean "includes, but is not limited to." The term "or" is to be read as "and/or" unless the context clearly indicates otherwise. The term "based on" is to be read as "based at least in part on." The term "being operable to" is to mean a function, an action, a motion or a state can be achieved by an operation induced by a user or an external mechanism. The term "one embodiment" and "an embodiment" are to be read as "at least one embodiment." The term "another embodiment" is to be read as "at least one other embodiment." The terms "first," "second," and the like may refer to different or same objects. Other definitions, explicit and implicit, may be included below. A definition of a term is consistent throughout the description unless the context clearly indicates otherwise.

According to embodiments of the present disclosure, a lidding system is provided so as to reduce the workload of lidding a lid on the container after portioning, and improving the food safety. The system for lidding a container comprises: a conveying device configured to convey a container, the container having a non-circular opening; a lid retaining assembly configured to retain a lid in a fixed orientation; and a container adjustment device configured to adjust a posture of the container to be lidded on the conveying device, so that the opening of the container is aligned with the lid. The above idea may be implemented in various manners, as will be described in detail in the following paragraphs.

Figure 2:
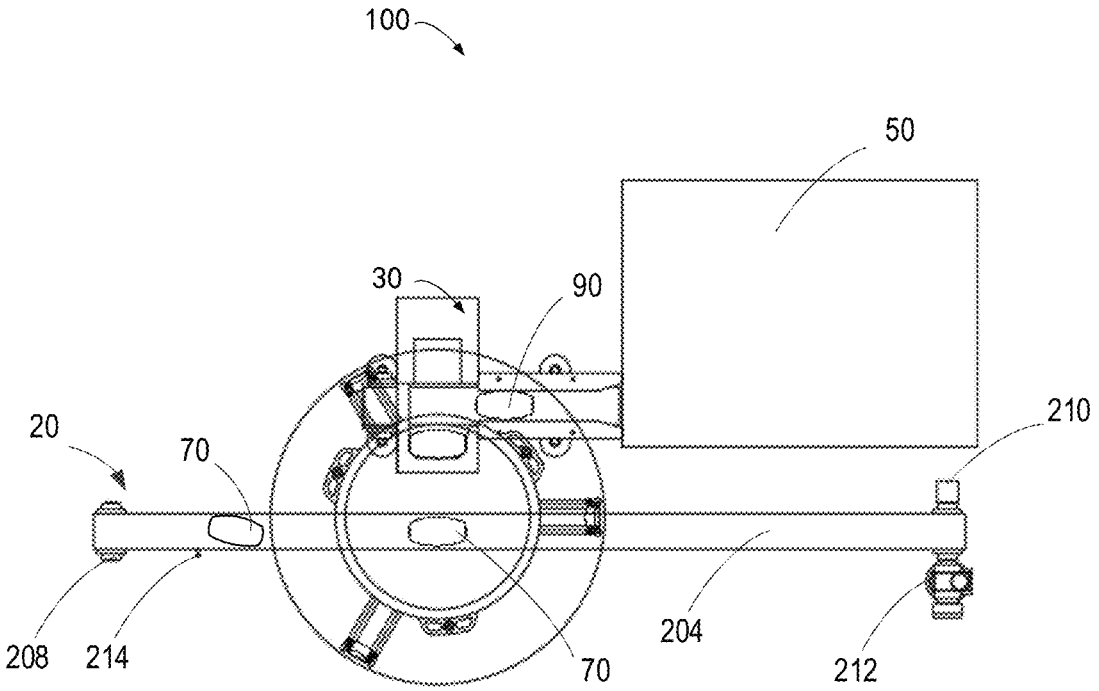
FIG. 2 is a top view of the system as shown in FIG. 1.

Hereinafter, the principles of the present disclosure will be described in detail with reference to FIGS. 1-15. Referring to FIGS. 1 and 2 first, FIG. 1 is a schematic front view illustrating a system for lidding a container in accordance with an embodiment of the present disclosure; FIG. 2 is a top view of the system as shown in FIG. 1.

In some embodiments, as shown in FIGS. 1 and 2, the system 100 includes a robot 10, a conveying device 20, a robot support 60, a lid separator 50. The robot 10 includes upper arms 108, parallel arms 102, robot base box 106, and robot gripper 40. As shown in FIGS. 1 and 2, the robot 10 may include three upper arms 108, and three parallel arms 102 connected with the three upper arms 108, respectively. The ends of each of the parallel arms 102 are coupled to the robot gripper 40 via for example, a mounting flange 103. And the end of each parallel arm 102 is configured to move within a three-dimensional working area covering at least part of the area of the conveying device 20 and a lid distribution device 30. The robot gripper 40 is configured to move with the parallel arms 102, which will be described in detail hereinafter. The robot base box 106 may include drive mechanism and circuitry. The lid separator 50 is arranged adjacent to the lid distribution device 30, and configured to separate stacked lids one by one and place them on the second conveying belt 302.

In some embodiments, the conveying device 20 may include an electric motor 212, a first conveying belt 204, drive roll, an idler roll 208, legs 216 and adjustable feet 218. The drive roll is driven by the electric motor 212, and in turn drives the first conveying belt 204 to run. A container 70 is placed on the first conveying belt 204 and moves with the first conveying belt 204 in the first direction X from the left to the right.

In some embodiments, the system 100 may include a position and speed determination device configured to determine the position and speed of the container.

In some embodiments, the system may comprise a position and speed determination device comprising a sensor 214, an encoder 210 and a position and speed determination unit. The sensor 214 is configured to sense the container 70 and generate an indication signal when the container 70 enters a working area of the robot gripper 40. In some embodiments, the sensor 214 may be a photo-sensor, arranged on the upstream side (left side in FIGS. 1 and 2) of the conveying device 20. The encoder 210 is rotatably arranged on a drive roller of the conveying device 20 configured to periodically transmit pulse signals with the rotation of the drive roller. The position and speed determination unit is configured to determine a position and speed of the container 70 based on the number of pulse signals and the indication signal.

In some embodiments, the encoder 210 may for example transmit 1024 pulse signals per second. Since the encoder 210 rotates with the drive roller of the conveying device 20, and the diameter of the drive roller is known, and thus the circumferential speed of the drive roller and in turn the moving speed of the first conveying belt 204 can be determined. When the indication signal of the sensor 214 is received, the number of the pulse signals is counted. Based on the number of the pulse signals and the known distance corresponding to a pulse signal, the speed of the container 70 and the position of the container 70 on the first conveying belt 204 can be determined in real time. In some embodiments, a position and speed determination unit is included and configured to determine the position and speed of the container 70 located in the working area based on the number of pulse signals, the speed of the drive roller and the first signal.

In some embodiments, the system 100 may include a lidding device configured to lid the lid 90 over the opening of the container 70 after the posture of container 70 has been adjusted. In some embodiments, the procedure of lidding the container may be as follows.

In some embodiments, when a container 70 1*s* conveyed to enter the working area of the robot gripper 40, the sensor 214 senses the arrival of the container, and generates an indication signal (or referred to as trigger signal) and transmits the same to a controller of the robot In some embodiments, the controller of the robot may instruct the position and speed determination unit to determine the position and speed of the container. In some embodiments, the position and speed determination unit may be a robot tracking unit, which can monitor the movement state of the conveyor and the container. The encoder 210 periodically transmits pulse signals in according with the rotation of the drive roll of the conveying device 20. The real-time position and speed of the container 70 is determined by the determination unit based on the number of pulse signals and the indication signal. In some embodiments, based on the position and the speed determined by the determination unit, or in some embodiments, in conjunction with the movement state of the container monitored by a robot tracking unit, the lid is picked up from the specified position by the lid retaining assembly. Specifically, the sucker picks up the positioned lid and retains it in a fixed orientation. Then the lid retaining assembly holds the lid and moves toward the container.

The lid retaining assembly tracks the container 70. When the lid retaining assembly reaches above of the container 70 and synchronizes with the lid retaining assembly, the container adjustment device adjusts the posture of the container 70. As an example, the opposite sides of the container 70 are clamped by the container adjustment device. After that, the container adjustment device reduces the pressure on the sides. The robot gripper 40, in particular, the lidding device is lowered to place the lid over the opening of the container 70 after the posture of container 70 has been adjusted. Generally speaking, after the adjustment, the opening of the container is aligned with the lid. In other embodiments, in order to ensure that the lid is fully aligned with the container, image recognition technology may also be used. Further adjustment may be made based on image recognition. For example, the position of the cover relative to the container opening can be changed.

In some embodiments, the lidding device may be combined with the lid retaining assembly. As an example, the suckers may be acted as the lidding device. In some other embodiments, the lidding device and the lid retaining assembly may be separated. As an example, a separated lidding device may be arranged on the robot gripper 40.

In some embodiments, the container may be lidded continuously without stopping the conveying belt. In some embodiments, it can also be operated intermittently by stopping the conveying belt temporally.

With such arrangement, the positon of the container 70 can be accurately determined, and the posture of the container 70 can be adjusted, and thus the container 70 can be lidded accurately and efficiently.

Figure 3:
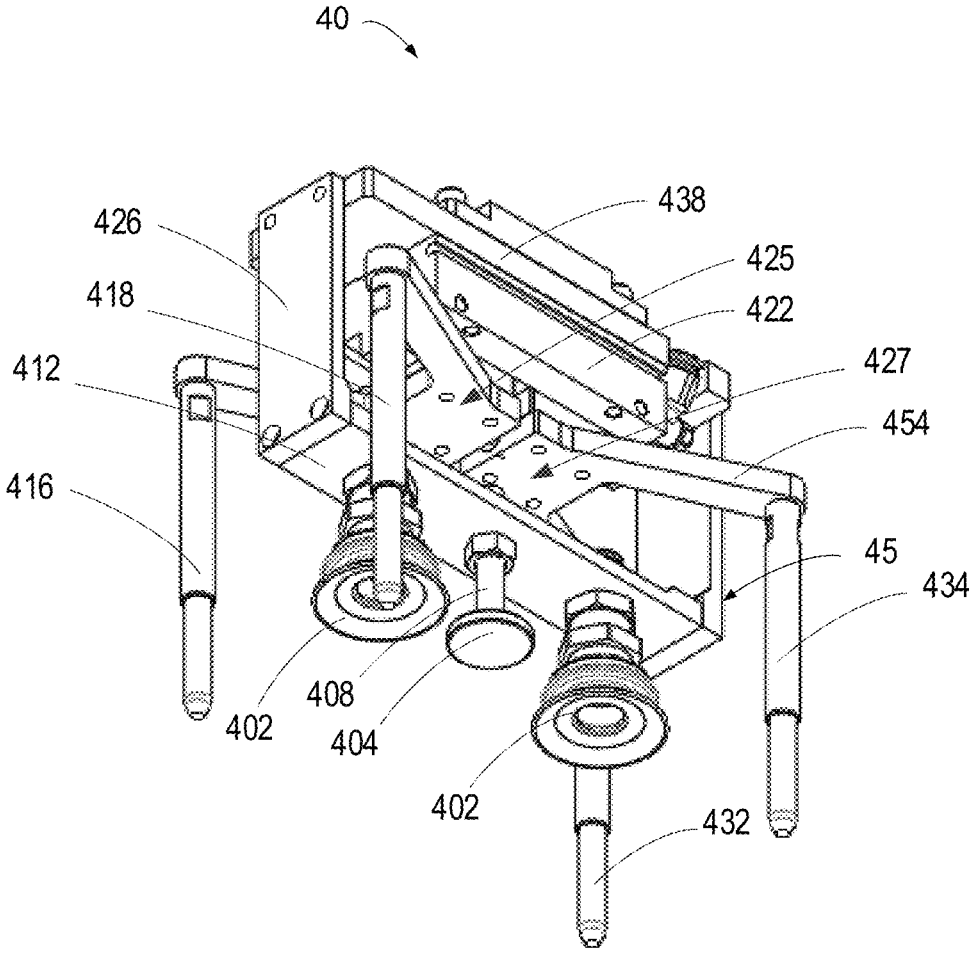
FIG. 3 is a perspective view of a robot gripper in accordance with an embodiment of the present disclosure.
Figure 4:
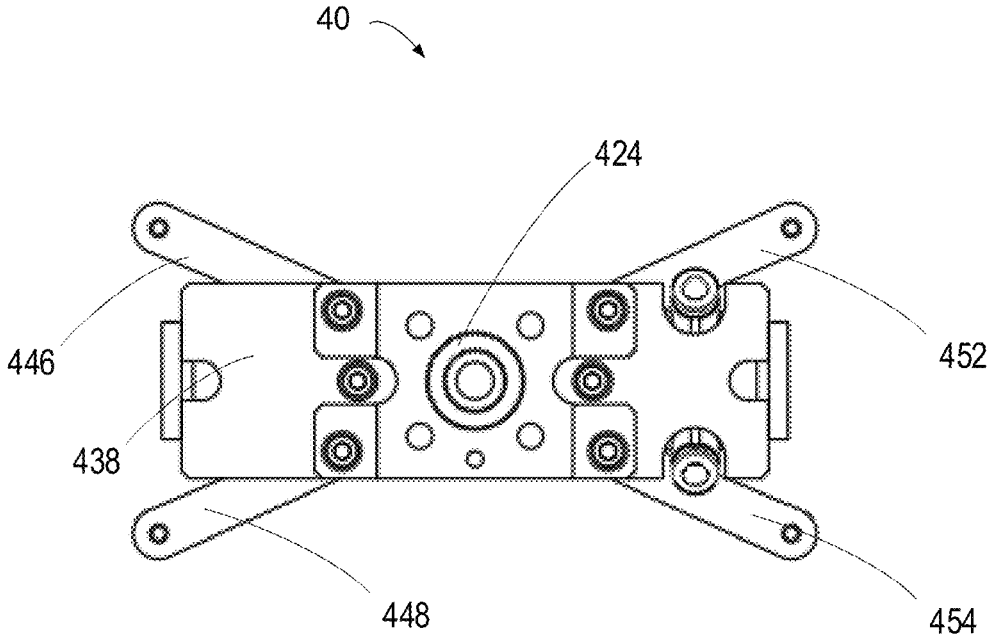
FIG. 4 is a top view of robot gripper as shown in FIG. 3.
Figure 5:
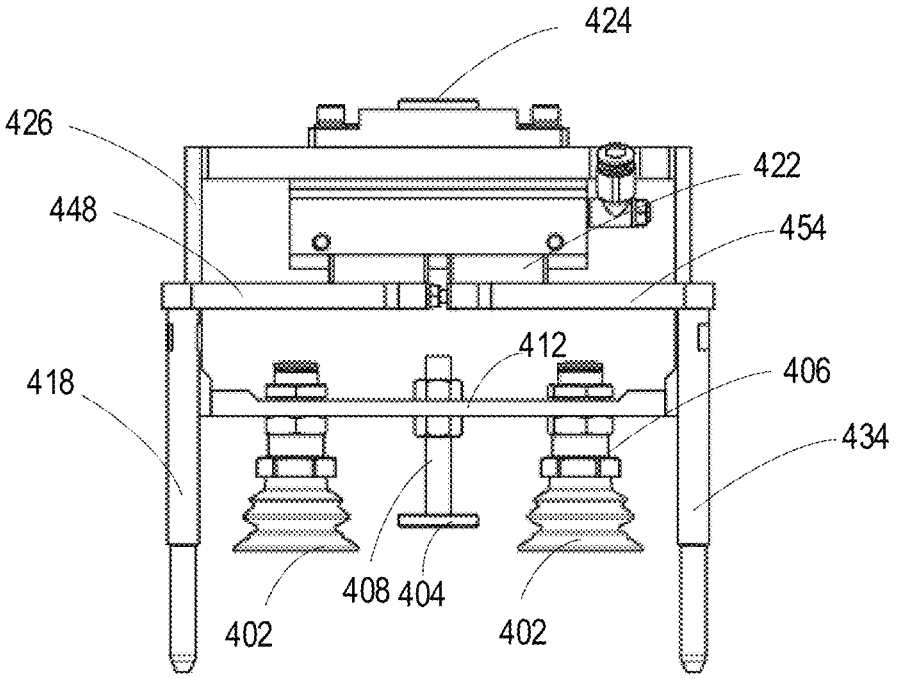
FIG. 5 is a front view of the robot gripper as shown in FIG. 3.
Figure 6:
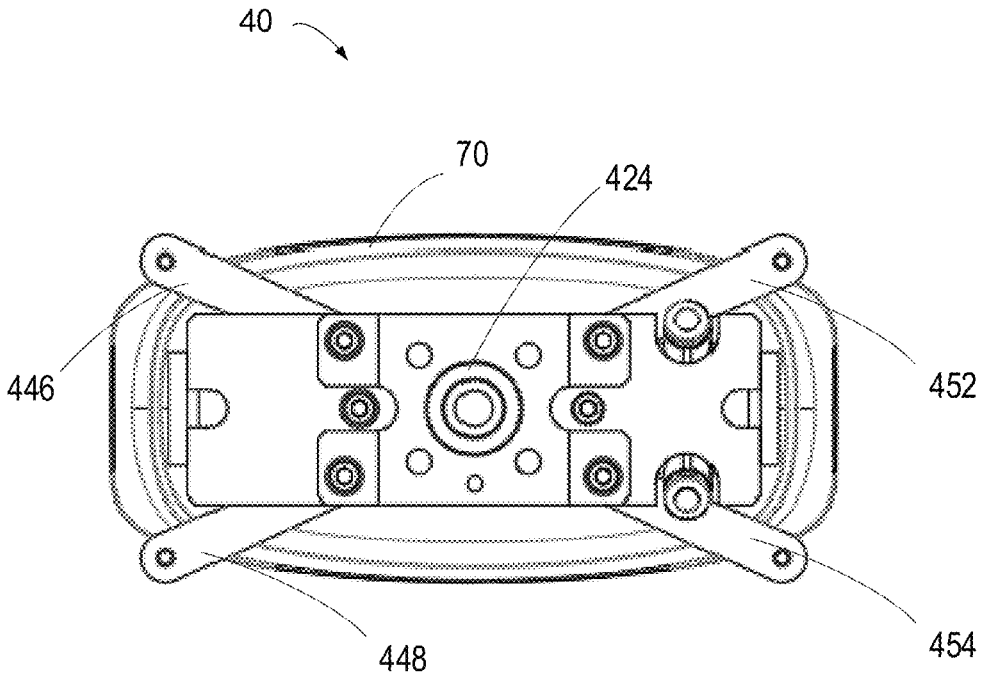
FIG. 6 is a top view of robot gripper clamping a lid as shown in FIG. 3.
Figure 7:
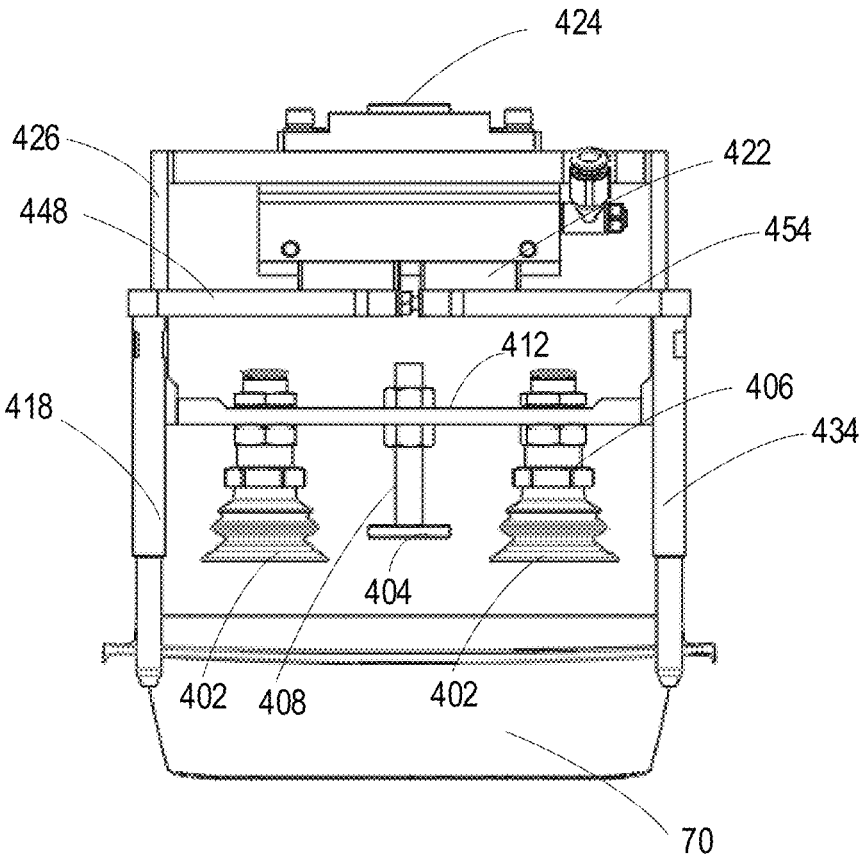
FIG. 7 is a front view of the robot gripper clamping a lid as shown in FIG. 3.

The example construction and operation of the robot gripper 40 will be described with reference to FIG. 3 to FIG. 7. FIG. 3 is a perspective view of a robot gripper in accordance with an embodiment of the present disclosure; FIG. 4 is a top view of robot gripper as shown in FIG. 3; FIG. 5 is a front view of the robot gripper as shown in FIG. 3; FIG. 6 is a top view of robot gripper clamping a lid as shown in FIG. 3; FIG. 7 is a front view of the robot gripper clamping a lid as shown in FIG. 3.

In some embodiments, the robot gripper 40 may include a lid retaining assembly and container adjustment device. The lid retaining assembly is configured to retain a lid 90 in a fixed orientation. The container adjustment device is configured to adjust a posture of the container 70 to be lidded on the conveying device 20, so that the opening of the container 70 is aligned with the lid.

In some embodiments, as shown in FIG. 3, the container adjustment device includes a first adjustment assembly 425 and a second adjustment assembly 427. The first adjustment assembly 425 and the second adjustment assembly 427 are configured to move between a first predetermined position in which the first adjustment assembly 425 and the second adjustment assembly 427 are far away from each other such that the container 70 can enter a gap formed by the first adjustment assembly 425 and the second adjustment assembly 427 and a second predetermined position in which the first adjustment assembly 425 and the second adjustment assembly 427 approach such that the gap can be narrowed so as to adjust the posture of the container 70 by the approach movement of the first adjustment assembly 425 and the second adjustment assembly 427, wherein an orientation of the gap is consistent with the orientation of the opening of the container 70 when the first adjustment assembly 425 and the second adjustment assembly 427 are at the second predetermined position.

With the arrangement as mentioned above, the posture of the container 70 can be adjusted conveniently and reliably in a low-cost way.

In some embodiments, as shown in FIG. 3, the robot gripper 40 may further includes a fixing frame 45. The fixing frame 45 may comprises a first plate 438, a second plate 412 and connecting plates 426. The first plate 438 is coupled to a mounting flange. A second plate 412 is arranged opposite to the first plate 438. The connecting plates 426 fixedly connect the first plate 438 and the second plate 412.

In some embodiments, the robot gripper 40 may include a lidding assembly and a container adjustment device. As shown in FIG. 4, the lidding assembly and the container adjustment device are coupled to the fixing frame 45.

Figure 16:
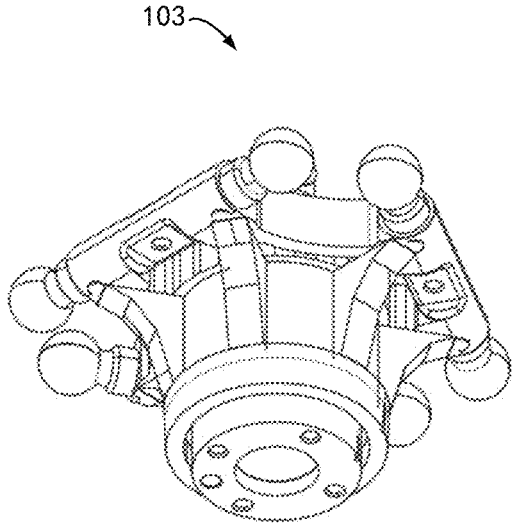
FIG. 16 is perspective view illustrating a mounting flange in accordance with an embodiment of the present disclosure.

As shown in FIG. 4, the robot gripper 40 further includes a locating structure 424. The locating structure 424 is configured to couple to a mounting flange, via which the fixing frame 45 is coupled to a mounting flange 103 (see FIGS. 1 and 16).

The fixing frame 45 as shown in the figures is only illustrative. The fixing frame 45 may be implemented in various manners in accordance with embodiments of the present disclosure. It is to be understood that the scope of the present disclosure is not intended to be limited in this respect. Other configuration is also possible.

In some embodiments, the lidding assembly is configured to pick up a lid conveyed by the lid distribution device 30 to the specified position and lid the lid on the opening of container 70 based on the determined position of the container 70.

In some embodiments, as shown in FIGS. 3 and 5, the lid retaining assembly comprises at least one flexible suckers 402 configured to suck a top surface of the lid, wherein the at least one flexible suckers 402 are configured to retain the lid in a fixed and predetermined orientation.

In some embodiments, as shown in FIGS. 3 and 5, the suckers 402 are coupled with a first support part 406, which fixedly couples the back side of the sucker 402 to the second plate 412.

In some embodiments, the lid retaining assembly further comprises a sucker auxiliary part having a rigid surface configured to abut against the top surface of the lid when the sucker sucks the lid.

In some embodiments, as shown in FIGS. 3 and 5, the sucker auxiliary part comprises an auxiliary plate 404 and a second support part 408. The auxiliary plate 404 has a flat surface extending parallel to the suck surface of the sucker 402, which is adapted to abut against the top surface of the lid when the suck surface of the sucker 402 sucks the lid 90. The second support part 408 is located between the two suckers 402 and coupling the plate-shaped part to the second plate 412.

It is to be understood that the embodiment of the invention is not limited to provide two suckers 402 in the robot gripper 40, in particular, in the lid retaining assembly, but more suckers can be used as required. Moreover, the lid retaining assembly is not limited the configuration mentioned above.

In some embodiments, the container adjustment device comprises an actuating assembly. As an example, the actuating assembly may be a pneumatic gripper 422 configured to drive the first adjustment assembly 425 and a second adjustment assembly 427. It is to be understood, the actuating assembly is not limited to the pneumatic gripper, instead, other types of grippers are also possible, such as an electric gripper and a magnetic gripper.

In some embodiments, as shown in FIG. 3, the pneumatic gripper 422 is coupled to the first plate 438 of the fixing frame 45. The pneumatic gripper 422 will be described in detail hereinafter.

In some embodiments, as shown in FIG. 3, the first adjustment assembly 425 and the second adjustment assembly 427 extend between the first plate 438 and the second plate 412. The pneumatic gripper 422 is configured to drive the first adjustment assembly 425 and the second adjustment assembly 427 to approach each other during lidding the lid to the opening of the container 70, so that the first adjustment assembly 425 and the second adjustment assembly 427 contact the opposite sides of the container 70 to orient the container 70, for example, in the first direction X.

In some embodiments, as shown in FIG. 3 and FIG. 5, the first adjustment assembly 425 comprises a first pole 416 and a second pole 418 extending in parallel with the first pole 416, the first pole and the second pole being configured to contact a first side of the container 70 when the first adjustment assembly 425 and the second adjustment assembly 427 are at the second predetermined position; and the second adjustment assembly 427 comprises a third pole 432 and a fourth pole 434 extending in parallel with third pole 432, the third pole and the fourth pole being configured to contact a second side of the container 70 opposite to the first side when the first adjustment assembly 425 and the second adjustment assembly 427 are at the second predetermined position.

In some embodiments, the structure of the robot gripper 40 is described. However, it is to be understood that the illustrated structure is only an example of the robot gripper 40. The robot gripper 40 is not limited to the configuration as described above, but may be of any other configuration. The scope of the present disclosure is not intended to be limited in this respect.

In some embodiments, for example, the first adjustment assembly 425 may comprises a first elongate member (not shown). The second adjustment assembly 427 may comprises a second elongate member (not shown). Wherein the first elongate member and the second elongate member are arranged opposite to each other. The first elongate member and the second elongate member are configured to contact the opposite sides of the container 70 respectively when the first adjustment assembly 425 and the second adjustment assembly 427 are at the second predetermined position. In some embodiments, each of the elongate members may be provided with a push part, which contact with the side of the container 70 at least at two positions.

With such an arrangement, the posture of the container can be adjusted in an efficient and reliable way.

In some embodiments, as shown in FIG. 4 and FIG. 6, container 70 is adjusted, for example, clamped by the first adjustment assembly 425 and a second adjustment assembly 427.

Back to FIG. 1, the orientation of the container 70 on the left side of the first conveying belt 204 is deviated from the direction of transmission. During lidding this container, the first adjustment assembly 425 and the second adjustment assembly 427 will adjust the posture of the container, such that the orientation of the container is consistent with a predetermined orientation. In particular, the first pole 416 and the second pole 418 will contact a first side of the container 70, and the third pole 432 and the fourth pole 434 will contact a second side of the container 70 opposite to the first side, whereby the orientation of the container 70 will be adjusted.

In some embodiments, as shown in FIGS. 3, 5 and 7, the lid retaining assembly comprises two suckers 402 coupled with the second plate (412) of the fixing frame 45.

However, it is to be understood that, in other embodiments, the number of the suckers 402 may be one or more than two depending to the actual requirement.

In some embodiments, the system 100 further comprises a lidding device configured to determine a position of the container 70 and to lid the lid over the opening of the container 70 after the posture of container 70 has been adjusted. As an alternative, lidding device is configured to lid the lid over the opening of the container 70 during the movement of the container 70.

In some embodiments, as shown in FIGS. 3 and 5, the first adjustment assembly 425 comprises a first pole 416 and a second pole 418 extending along the second direction Y from the end of the first beam part 446 and the end of the second beam part 448, respectively;

The second adjustment assembly comprises a third rod-shaped part 432 and a fourth rod-shaped part 434 extending along the second direction Y from the end of the third beam part 452 and the end of the fourth beam part 454, respectively.

As shown in FIGS. 6 and 7, the container 70 is clamped by the robot gripper 40. In particular, opposite sides of the robot gripper 40 are clamped by the first adjustment assembly 425 and the second adjustment assembly 427.

In some illustrated embodiments, two adjustment assemblies, i.e., the first adjustment assembly 425 and the second adjustment assembly 427 are shown in FIGS. 3-9. The first adjustment assembly 425 and the second adjustment assembly 427 are arranged on two sides respectively and coupled by an actuating assembly. In some embodiments, four adjustment assemblies may be included in the container adjustment device. In particular, a first group of two adjustment assemblies may be coupled by an actuating assembly, and a second group of two adjustment assemblies may be coupled by another actuating assembly. And the two groups of adjustment assemblies may be set crosswise. With such an arrangement, the two groups of adjustment assemblies may move relative to each other along the diagonal. As a result, the sides of the container 70 are adjusted by the adjustment assemblies.

Figure 8:
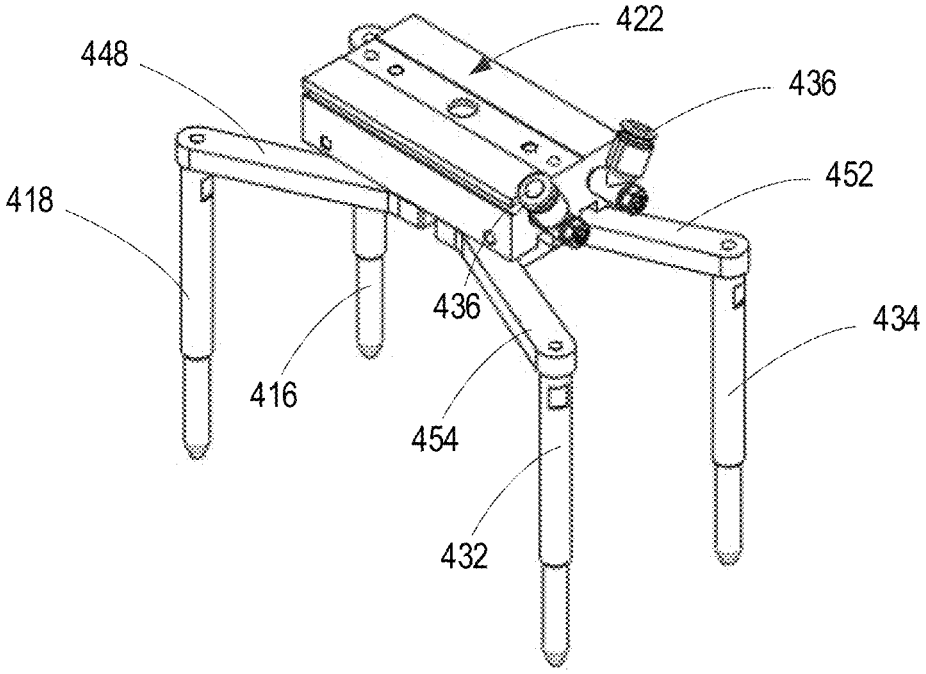
FIG. 8 is a perspective view illustrating a container adjustment device in accordance with an embodiment of the present disclosure.
Figure 9:
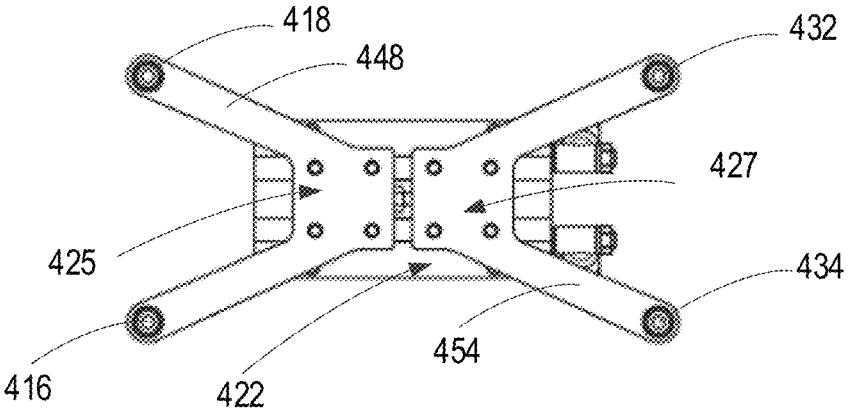
FIG. 9 is a bottom view of the container adjustment device as shown in FIG. 8.

The configuration of the container adjustment device will be further described with reference to FIGS. 8 and 9. FIG. 8 is a perspective view illustrating a container adjustment device in accordance with an embodiment of the present disclosure; FIG. 9 is a bottom view of the container adjustment device as shown in FIG. 8.

As shown in FIS. 8 and 9, the pneumatic gripper 422 is arranged on the first adjustment assembly 425 and the second adjustment assembly 427. The first adjustment assembly 425 and the second adjustment assembly 427 are apart from each other, and moveably coupled with the pneumatic gripper 422. The pneumatic gripper 422 is configured to drive the first adjustment assembly 425 and the second adjustment assembly 427 to approach each other during lidding container 70, so that the first pole 416 and the second pole 418 contact a first side of the container 70 when the first adjustment assembly 425 and the second adjustment assembly 427 are at the second predetermined position, and the third pole 432 and the fourth pole 434 contact a second side of the container 70 opposite to the first side when the first adjustment assembly 425 and the second adjustment assembly 427 are at the second predetermined position.

Some configurations of the container adjustment device are described with reference to the figures, the scope of the present disclosure is not intended to be limited in this respect. Other configuration is also possible.

Figure 10:
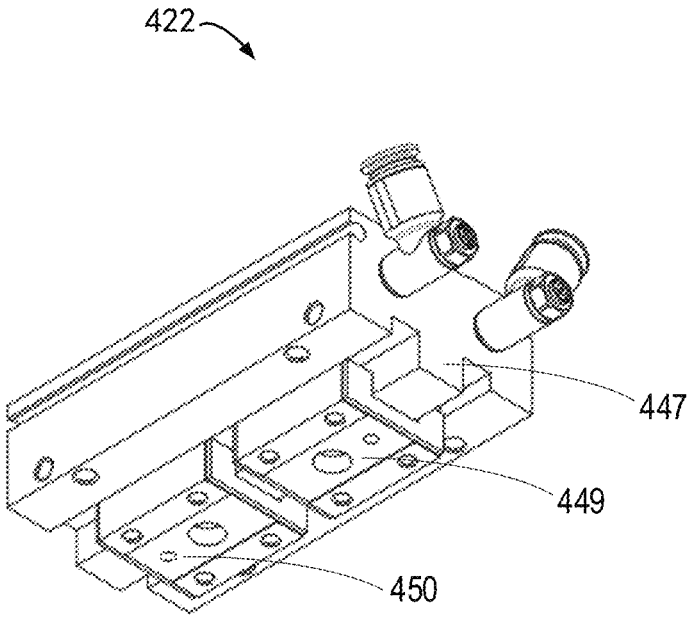
FIG. 10 is perspective view illustrating an actuating assembly as shown in FIG. 8.
Figure 11:
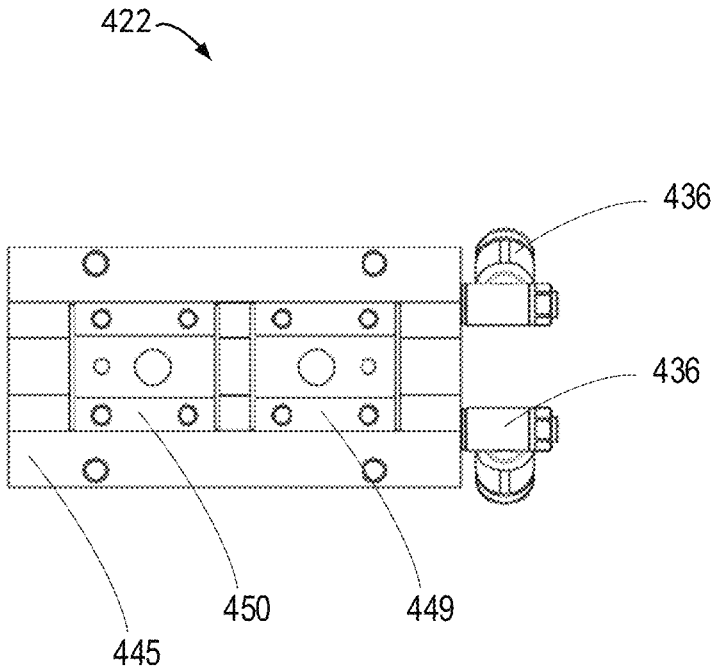
FIG. 11 is bottom view of the an actuating assembly as shown in FIG. 10.

The actuating assembly 422 will be further described with reference to FIGS. 10 and 11. FIG. 10 is perspective view illustrating an actuating assembly as shown in FIG. 8; FIG. 11 is bottom view of the actuating assembly as shown in FIG. 10.

In some embodiments, the pneumatic gripper 422 is configured to drive the first adjustment assembly 425 and a second adjustment assembly 427. In some embodiments, the pneumatic gripper 422 comprises a body defining a chamber and two pistons received in the chamber, the two pistons are configured to move in response to pressure increase and decrease in the chamber, and the first adjustment assembly 425 and the second adjustment assembly 427 are coupled to the two pistons respectively via a link-mechanism.

In some embodiments, as shown in FIG. 10, a guide part 447 is provided in the body defining a chamber and two pistons received in the chamber. The first movable part 449 and the second movable part 450 are coupled with the two pistons in the chamber (not shown). The actuating assembly 422 further comprises terminals 436 through which hydraulic pressure or electric power is applied to drive the first movable part 449 and the second movable part 450 to move. The first movable part 449 and the second movable part 450 are configured to move along the guide part 447 in response to the variation of the power input via the input terminals 436. For example, the first movable part 449 and the second movable part 450 move in response to pressure increase and decrease in the chamber.

In some embodiments, the actuating assembly 422 comprises a body extending in a plane perpendicular to the second direction Y. The first movable part 449 and the second movable part 450 are located in the body and movable relative along the extension direction of the body. The first movable part 449 and the second movable part 450 are coupled with the first adjustment assembly 425 and the second adjustment assembly 427, respectively, to drive the first movable part 449 and the second movable part 450 to move relative to each other. In some embodiments, the first movable part 449 and the second movable part 450 are coupled with pistons arranged in the chamber.

In some embodiments, the container adjustment device comprises a first adjustment assembly 425 and a second adjustment assembly 427. The first adjustment assembly 425 comprises a pair of first movably coupled poles. The second adjustment assembly comprises a pair of second movably coupled poles. The first adjustment assembly 425 and the second adjustment assembly 427 are set crosswise, such that the first movably coupled poles and the second movably coupled poles are adapted to move along a diagonal, respectively, to contact the opposite sides of the container.

In some embodiments, the container adjustment device is arranged adjacent to the lidding assembly, which is suitable for adjusting the posture of the first container 70 to be lidded on the conveying device 20 during the lidding of the lidding assembly, so that the opening of the first container 70 is aligned with the first lid.

With the arrangement of the container adjustment device, the posture of a container can be adjusted reliably and quickly, thereby the efficiency of lidding a lid on the container after portioning is significantly improved.

It is to be understood that the container adjustment device is not limited to the configuration as described above, but may be of any other configuration. The scope of the present disclosure is not intended to be limited in this respect.

In some embodiments, the lidding system may further comprises a lid distribution device 30 (also referred to as lid positioning device) configured to distribute the lid to a predetermined position with the lid being in a predetermined orientation. The lid distribution device will be described in detail hereinafter with reference to FIGS. 12-15.

Figure 12:
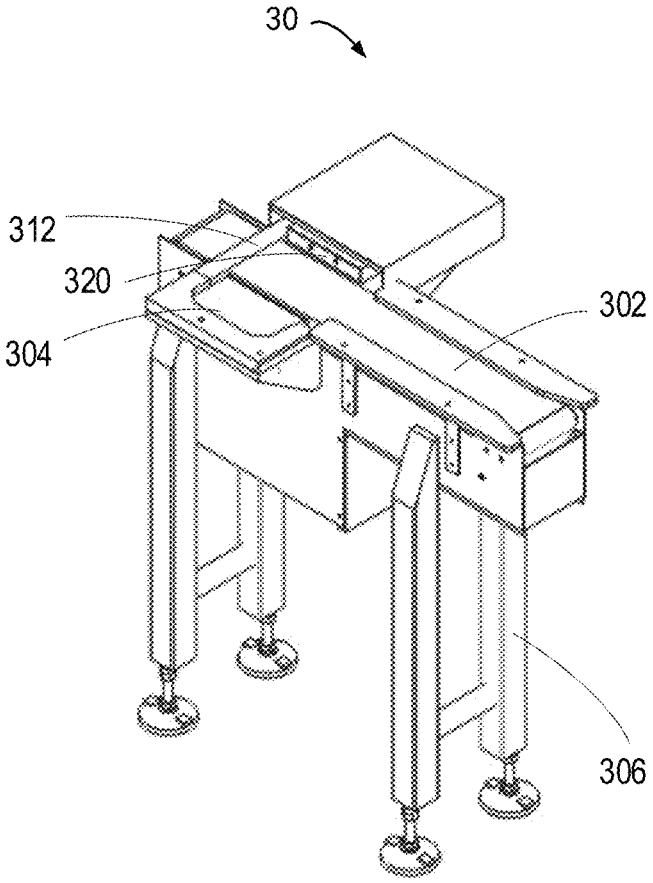
FIG. 12 is a schematic view illustrating a lid distribution device 30 in a first state in accordance with an embodiment of the present disclosure.
Figure 13:
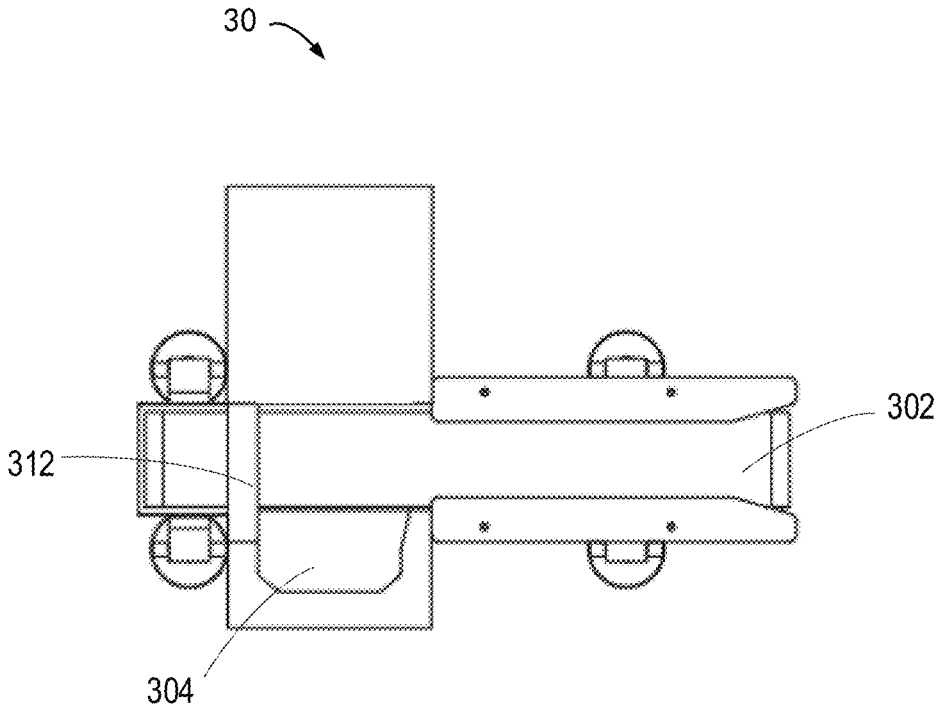
FIG. 13 is a top view of the lid distribution device 30 as shown in FIG. 12.
Figure 14:
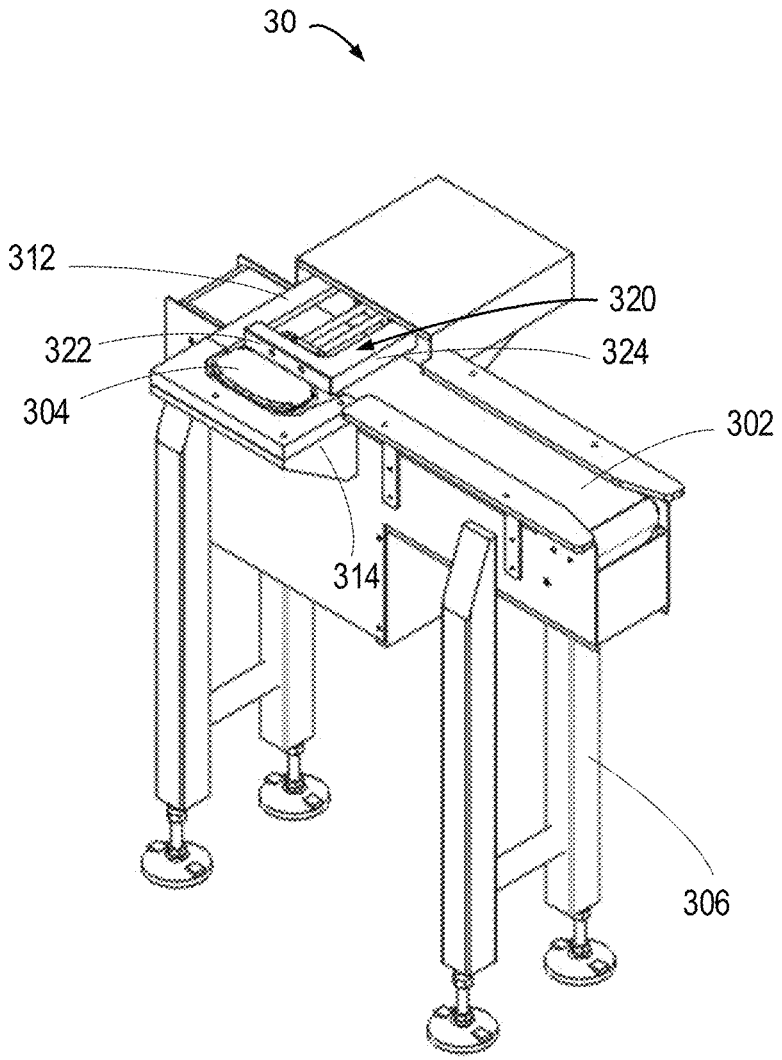
FIG. 14 is a schematic view illustrating a lid distribution device 30 in a second state in accordance with an embodiment of the present disclosure.
Figure 15:
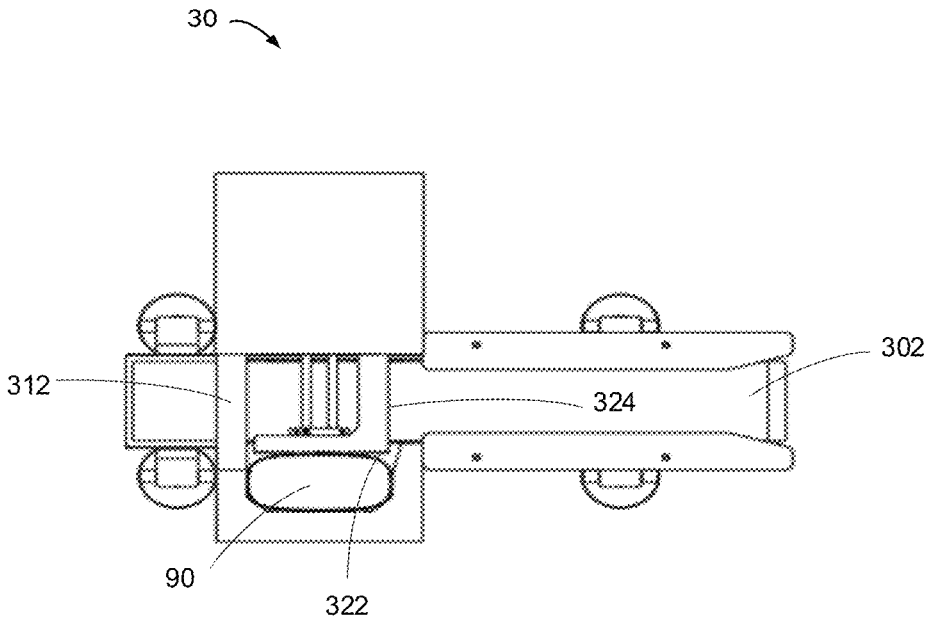
FIG. 15 is a top view of the lid distribution device 30 as shown in FIG. 14.

FIG. 12 is a schematic view illustrating a lid distribution device 30 in a first state in accordance with an embodiment of the present disclosure; FIG. 13 is a top view of the lid distribution device 30 as shown in FIG. 12; FIG. 14 is a schematic view illustrating a lid distribution device 30 in a second state in accordance with an embodiment of the present disclosure; FIG. 15 is top view of the lid distribution device 30 as shown in FIG. 14.

In some embodiments, the lid distribution device 30 comprises a second conveying belt 302, a pickup station 314, and a pusher and supporting parts 306. The second conveying belt 302 comprises two opposite walls for supporting the lid. The pickup station 314 comprises a groove 304 at which the lid is to be picked up by lid retaining assembly. The pusher is configured to push the lid on the second conveying belt 302 to the groove 304.

In some embodiments, the pusher comprises a movable plate 320 comprising a first side 322 and a second side 324, the first side 322 is configured to push the lid, and the second side 324 is configured to block a subsequent lid.

The lid distribution device 30 is configured to position the first lid conveyed by the second conveying belt 302 to the specified position, so as to facilitate the lidding assembly to pick up the first lid.

In some embodiments, as shown in FIGS. 12-15, the opening 304 is arranged adjacent to the edge of the second conveying belt 302 of the lid distribution device 30. The pusher is arranged inside a box and opposite to the opening 304, and adapted to move in a direction perpendicular to the second conveying belt 302. When a lid reaches the edge of a baffle 312, the lid is stopped. The movable plate 320 is pushed out of the box. As a result, the lid is pushed into the opening 304. In other words, the lid is located in the opening 304. With such an arrangement, the lid retaining assembly can accurately pick up the lid and retain a lid in a fixed orientation, whereby it is helpful to lid accurately the lid on the opening of the container 70.

It is to be understood that the container adjustment device is not limited to the configuration as described above, but may be of any other configuration. The scope of the present disclosure is not intended to be limited in this respect.

A system for lidding a container is described. The system may be implemented in various configurations in accordance with embodiments of the present disclosure. The scope of the present disclosure is not intended to be limited in this respect.

With such arrangement, the workload of lidding a lid on the container is reduced and the efficiency of lidding the container is significant improved. And the food safety is enhanced.

The operation of the system for lidding a container will be described hereinafter. In some embodiments, the method for lidding a container may comprises:

- conveying a container, the container having a non-circular opening, as an alternative, a container having a circular opening is also possible;
- retaining a lid in a fixed direction; wherein the lid can be supplied to the lid retaining assembly in any manner;
- adjusting the posture of the container to be lidded, so that the opening of the container is aligned with the lid; and
- lidding the lid over the aligned opening of the container.

In some embodiments, adjusting the posture of the container to be lidded may comprises:

- moving a first adjustment assembly 425 and a second adjustment assembly 427 between a first predetermined position in which the first adjustment assembly 425 and the second adjustment assembly 427 are far away from each other such that the container can enter a gap formed by the first adjustment assembly 425 and the second adjustment assembly 427 and a second predetermined position in which the first adjustment assembly 425 and the second adjustment assembly 427 approach such that the gap can be narrowed so as to adjust the posture of the container by the approach movement of the first adjustment assembly 425 and the second adjustment assembly 427.

As an example, the operation of lidding a container may be as follows:

When a container 70 enters the working area of the robot gripper 40, a sensor senses the arrival of the container, and generates an indication signal and transmits the same to a determination unit.

An encoder periodically transmits pulse signals according with the rotation of the drive roll of the conveying device 20. The real-time position of the container 70 is determined by the position and speed determination unit based on the number of pulse signals and the indication signal.

The lids are separated by the lid separator 50, and then sent to the robot working area through the lid distribution device 30, and located by the lid positioning (distribution) device.

The lid retaining assembly, specifically, the sucker picks up the positioned lid and retains it in a fixed orientation. Then the lid retaining assembly holds the lid and move toward the container.

The lid retaining assembly tracks the container and the container adjustment device adjusts the posture of the container when the lid retaining assembly reaches above the container.

The lid is lidded over the opening of the container 70 by the lidding device after the posture of container 70 has been adjusted. Generally speaking, after the adjustment, the opening of the container is aligned with the lid. In other embodiments, in order to ensure that the lid is fully aligned with the container, image recognition technology may also be used. Further adjustment may be made based on image recognition. For example, the position of the cover relative to the container opening can be changed.

In some embodiments, lid is lidded over the opening of the container when the container is moving. As an alternative, the container may be stopped temporarily, then the lid is lidded over the opening of the container by a lidding device.

The operation of lidding a container described above is only illustrative. The scope of the present disclosure is not intended to be limited in this respect.

The system and method for lidding a container can be applied on food portioning industry. Actually, the system and method is not limited to food portioning industry, but can be used in a wider range of industries. For example, the system and method can be used in any industry that needs to lid a container.

The system and method are described with respect to container having non-circular opening. The scope of the present disclosure is not intended to be limited in this respect. The system and method is not limited to this. Containers with circular openings can also be used as needed.

It is to be understood that the system is not limited to the configuration as described above, but may be of any other configuration. The scope of the present disclosure is not intended to be limited in this respect.

Moreover, the system can be combined with one or more additional apparatus to operate as needed. The scope of the present disclosure is not intended to be limited in this respect.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A system for lidding a container, comprising:

a conveying device configured to convey the container, the container having a non-circular opening;

a lid retaining assembly configured to retain a lid in a fixed orientation;

a container adjustment device configured to adjust a posture of the container to be lidded on the conveying device, so that the opening of the container is aligned with the lid; and a position and speed determination device comprising:

a sensor configured to generate an indication signal when the container enters a working area;

an encoder rotatably arranged on a drive roller of the conveying device configured to periodically transmit pulse signals with the rotation of the drive roller; and a position and speed determination unit configured to determine the position and speed of the container based on a number of the pulse signals and the indication signal.

2. The system according to claim 1, wherein the container adjustment device comprises a first adjustment assembly and a second adjustment assembly, wherein the first adjustment assembly and the second adjustment assembly are configured to move between a first predetermined position in which the first adjustment assembly and the second adjustment assembly are far away from each other such that the container can enter a gap formed by the first adjustment assembly and the second adjustment assembly and a second predetermined position in which the first adjustment assembly and the second adjustment assembly approach such that the gap can be narrowed so as to adjust the posture of the container by the approach movement of the first adjustment assembly and the second adjustment assembly, and wherein an orientation of the gap is consistent with the orientation of the opening of the container when the first adjustment assembly and the second adjustment assembly are at the second predetermined position.

3. The system according to claim 2, wherein the container adjustment device further comprises a gripper configured to drive the first adjustment assembly and the second adjustment assembly.

4. The system according to claim 3, wherein the gripper comprises:

a body defining a chamber and two pistons received in the chamber, the two pistons are configured to move in response to pressure increase and decrease in the chamber, and the first adjustment assembly and the second adjustment assembly are connected to the two pistons respectively via a link-mechanism.

5. The system according to claim 4, wherein the first adjustment assembly comprises at least a first pole and a second pole extending in parallel with the first pole, the first pole and the second pole being configured to contact a first side of the container at two different positions respectively when the first adjustment assembly and the second adjustment assembly are at the second predetermined position; and the second adjustment assembly comprises at least a third pole and a fourth pole extending in parallel with third pole, the third pole and the fourth pole being configured to contact a second side of the container opposite to the first side at two different positions when the first adjustment assembly and the second adjustment assembly are at the second predetermined position.

6. The system according to claim 4, wherein the first adjustment assembly comprises a first elongate member shaped to move the container into a predetermined orientation;

wherein the second adjustment assembly comprises a second elongate member shaped to move the container into a predetermined orientation; and wherein the first elongate member and the second elongate member are configured to contact the opposite sides of the container respectively when the first adjustment assembly and the second adjustment assembly are at the second predetermined position.

7. The system according to claim 1, wherein the lid retaining assembly comprises:

at least one flexible sucker configured to suck a top surface of the lid, wherein the at least one flexible sucker are configured to retain the lid in a fixed and predetermined orientation.

8. The system according to claim 7, wherein the lid retaining assembly further comprises:

a sucker auxiliary part having a rigid surface configured to abut against the top surface of the lid when the sucker sucks the lid.

9. The system according to claim 1, further comprising:

a lid distribution device configured to distribute the lid to a predetermined position with the lid being in a predetermined orientation.

10. The system according to claim 9, wherein the lid distribution device comprises:

a conveying belt comprising two opposite walls for supporting the lid;

a pick up station comprising a groove at which the lid is to be picked up by the lid retaining assembly; and a pusher configured to push the lid on the conveying belt to the groove.

11. The system according to claim 10, wherein the pusher comprises a movable member comprising a first side and a second side, the first side is configured to push the lid, and the second side is configured to block a subsequent lid.

12. The system according to claim 1, further comprising a lidding device configured to lid the lid over the opening of the container after the posture of the container has been adjusted.

13. A method for lidding a container, comprising:

conveying a container, by a conveying device, the container having a non-circular opening;

determining, by a position and speed determination device, a position and speed of the container based on a number of pulse signals and an indication signal, wherein the position and speed determination device comprises:

a sensor configured to generate the indication signal when the container enters a working area; and an encoder rotatably arranged on a drive roller of the conveying device configured to periodically transmit pulse signals with the rotation of the drive roller;

retaining a lid in a fixed direction;

adjusting the posture of the container to be lidded, so that the opening of the container is aligned with the lid; and lidding the lid over the aligned opening of the container.

14. The method according to claim 13, wherein adjusting the posture of the container to be lidded comprising:

moving a first adjustment assembly and a second adjustment assembly between a first predetermined position in which the first adjustment assembly and the second adjustment assembly are far away from each other such that the container can enter a gap formed by the first adjustment assembly and the second adjustment assembly and a second predetermined position in which the first adjustment assembly and the second adjustment assembly approach such that the gap can be narrowed so as to adjust the posture of the container by the approach movement of the first adjustment assembly and the second adjustment assembly.

15. A system for lidding a container, comprising:

a conveying device configured to convey the container, the container having a non-circular opening;

a lid retaining assembly configured to retain a lid in a fixed orientation;

a container adjustment device configured to adjust a posture of the container to be lidded on the conveying device, so that the opening of the container is aligned with the lid; and a lid distribution device configured to distribute the lid to a predetermined position with the lid being in a predetermined orientation;

wherein the lid distribution device comprises:

a conveying belt comprising two opposite walls for supporting the lid;

a pick up station comprising a groove at which the lid is to be picked up by the lid retaining assembly; and a pusher configured to push the lid on the conveying belt to the groove, wherein the pusher comprises a movable member comprising a first side and a second side, the first side is configured to push the lid, and the second side is configured to block a subsequent lid.

* * * * *